US005239795A

United States Patent [19]

Breaux

[11] Patent Number: 5,239,795

[45] Date of Patent: Aug. 31, 1993

[54] COMBINATION PULL-DOWN ATTIC STAIRS AND CEILING LIGHT

[76] Inventor: William J. Breaux, 307 Marvick, Pasadena, Tex. 77506

[21] Appl. No.: 879,750

[22] Filed: May 6, 1992

[51] Int. Cl.[5] ..... E04F 19/00

[52] U.S. Cl. ..... 52/182; 52/28; 182/81

[58] Field of Search ..... 52/19, 182, 28, 32, 52/39, 183; 182/77-82, 88

[56] References Cited

U.S. PATENT DOCUMENTS

| | | | |
|---|---|---|---|
| 1,811,709 | 6/1931 | Bessler . | |
| 2,384,743 | 9/1945 | Hill . | |
| 2,580,978 | 1/1952 | Triller | 182/80 |
| 2,691,718 | 10/1954 | Bowers | 52/182 |
| 2,766,372 | 10/1956 | Albris . | |
| 3,807,528 | 4/1974 | Frank . | |
| 4,365,449 | 12/1982 | Liautaud | 52/28 |
| 4,394,714 | 7/1983 | Rote . | |
| 4,438,604 | 3/1984 | McGourty, Jr. et al. | 52/28 |

FOREIGN PATENT DOCUMENTS

WO8301638 5/1983 World Int. Prop. O. .

OTHER PUBLICATIONS

Keller Ladders—Installation Instructions.
Builders Square, p. 31 (Feb. 26, 1992).

*Primary Examiner*—Carl D. Friedman
*Assistant Examiner*—Winnie Yip
*Attorney, Agent, or Firm*—Pravel, Hewitt, Kimball & Krieger

[57] ABSTRACT

A combination pull-down stairs and lighting assembly with the lighting assembly attached to the underside of the stairs such that, when retracted, the lighting assembly provides both cover for concealing the stairs and illumination for the space below the stairs. The lighting assembly can include a frame with a grating or translucent panel, or the lighting assembly can include a light fixture attached to a base plate.

19 Claims, 2 Drawing Sheets

COMBINATION PULL-DOWN ATTIC STAIRS AND CEILING LIGHT

FIELD OF THE INVENTION

This invention relates to pull-down stairs combined with a ceiling light. More specifically, this invention relates to foldable pull-down attic stairs that have a lighting assembly attached such that when the stairs are retracted into the ceiling, the lighting assembly conceals the stairs and the opening in the ceiling and is capable of providing lighting for the space below.

DESCRIPTION OF PRIOR ART

Since there have been attics, there have been ways of getting into those attics. One convenient way long used to reach these attics has been retractable stairs that can be easily pulled down for access to the attic, and yet, when retracted take up little or no usable space below a ceiling. While such stairs have long been known, they have also long been visible. They tend to leave an unsightly signature in an otherwise smooth ceiling. For this reason, placement of such retractable stairs has been aesthetically limited to an inconspicuous ceiling such as over a carport, above a hallway, or inside a closet. However, much useable attic space is typically located above more visible living space, e.g., living rooms, kitchens, bedrooms, or other rooms below available attic space. It would therefore be desirable to provide access to such attic space by way of a more attractive assembly. Because the more visible living spaces also benefit from ceiling light fixtures, this invention provides a solution to the threefold problem of unsightly signatures of pull-down stairs, the need for attic access above living space, and the need for ceiling mounted lighting.

SUMMARY OF THE INVENTION

The present invention is a combination attic pull-down steps and light fixture assembly. By providing a combination attic pull-down steps assembly with a ceiling light fixture, the present invention provides ceiling access to storage space above a room, concealment of that access, and lighting for the room in a single structure.

DETAILED DESCRIPTION OF THE ILLUSTRATED EMBODIMENT

Figure 2:
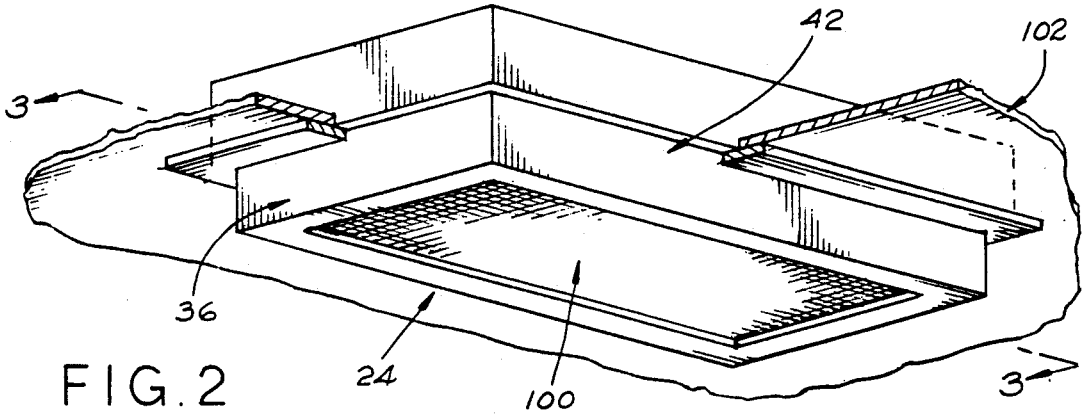
FIG. 2 is a perspective view of the combination pull-down attic stairs and ceiling light according to the invention, in its retracted state.
Figure 1:
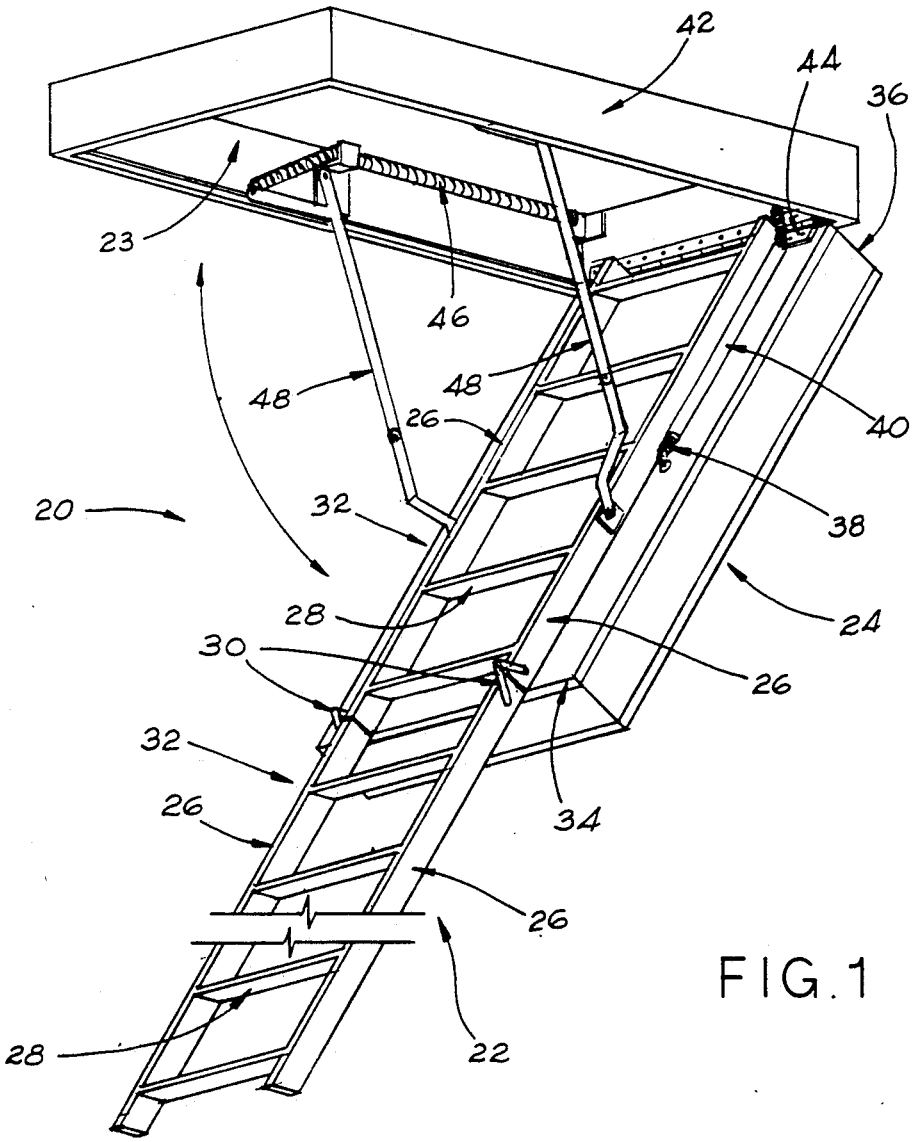
FIG. 1 is a perspective view showing the combination pull-down attic stairs and ceiling light according to the invention, in its extended state.

With reference to the drawings, the light fixture-attic steps combination of the instant invention is illustrated in FIG. 1 in its extended position for access to the attic storage area and in FIG. 2 with the light fixture concealing the ceiling aperture that provides access to the storage area.

As shown in FIG. 1, stair assembly 22 is mounted within a ceiling aperture 23 by way of an aperture frame 42. The stair assembly 22 includes one or more stair extensions 32 having steps 28 mounted between rails 26. The stair extensions 32 are joined together by joining hinges 30 to provide the foldable feature of the stair 10 assembly 22. A hinge 44 mounts the stair extensions 32 to one end of the aperture frame 42. Linkages 48 and ballast springs 46 complete the stair assembly 22, being mounted between the stair extensions 32 and the aperture frame 42. To retract the stair assembly 22 into the ceiling aperture 23, the stair extensions are folded at their joining hinges 30. Then, the folded stair extensions 32 are pivoted on the hinge 44 into the ceiling aperture 23, with the linkages 48 and the ballast springs 46 providing mechanical assistance.

Figure 3:
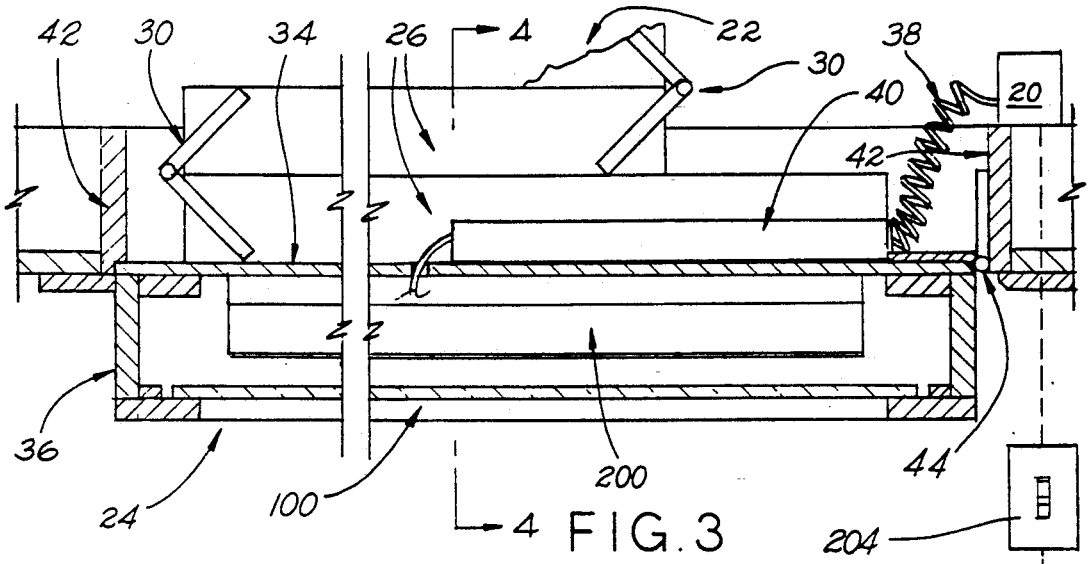
FIG. 3 is a cross-sectional side view of the combination pull-down attic stairs and ceiling light according to the invention, in its retracted state.
Figure 4:
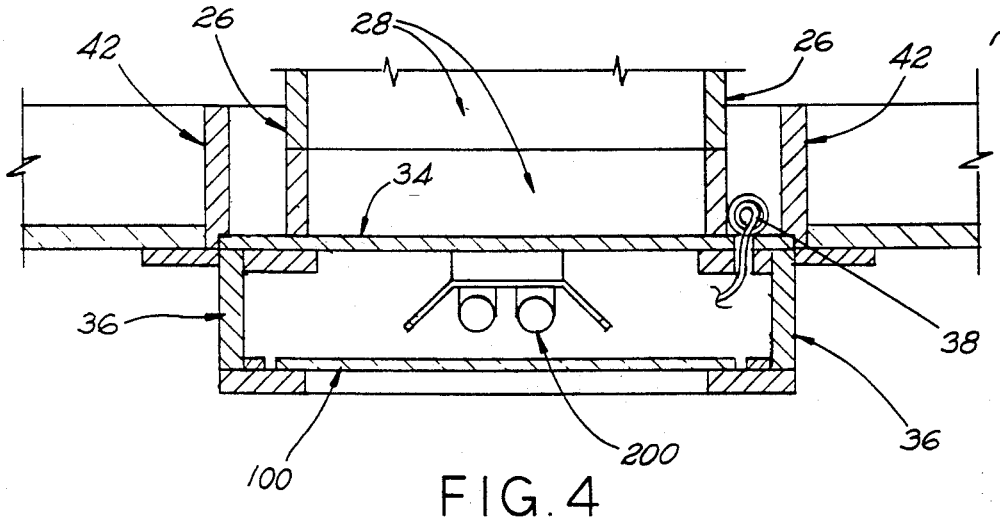
FIG. 4 is a cross-sectional end view of an embodiment of a combination pull-down attic stairs and ceiling light according to the invention, in its retracted state.
Figure 5:
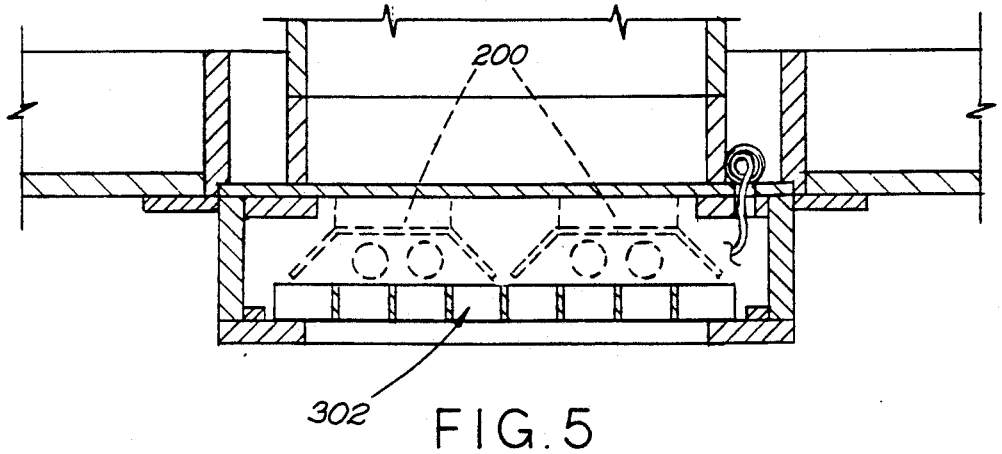
FIG. 5 is a cross-sectional end view of an alternative embodiment of a combination pull-down attic stairs and ceiling light according to the invention, in its retracted state.

In accordance with the invention, a lighting assembly 24 is shown mounted to the stair assembly 22 in FIG. 1 in its extended position. A base plate, such as a base plate 34, for conveniently mounting a light fixture 200, may be mounted to the stair extensions 32. With specific reference to FIGS. 3 and 4, the light fixture 200 is mounted to the base plate 34 with any suitable means such as mounting plates, brackets, or the like with screws, bolts, adhesives, wing nuts and bolts, or the like. As shown in FIGS. 3 and 4, a frame 36 may be provided to conceal the fixture and to mount a fixture cover, such as the translucent panels 100. The translucent panels 100 may be glass or plastic, and are conveniently mounted in spaced relation to the light fixture 200 by way of a frame 36 to conceal both the light fixture 200 and the base plate 34. As can be appreciated, any suitable light fixture can be used, including incandescent, fluorescent, or halogen fixtures, along with any type of cover which softens the light and hides the fixture, such as the grating 302 illustrated in FIG. 5.

The hinge 44 need not be mounted directly to the stair extensions 32, but could instead be mounted to the base plate 34. Then the stair extensions 32 would be mounted to the base plate 34, and the base plate 34 would pivot on the hinge 44. Alternatively, a double hinge could instead mount both the stair extensions 32 and the base plate 34 to the side of the aperture frame 42. By using a double hinge, the base plate 34, and thus the lighting assembly 24, could be separately pivoted away from the retracted stair extensions 32, providing access to the lighting assembly 24 from the top side. Then the lighting assembly 24 could be pivoted to cover the ceiling aperture 23, and the base plate 34 secured to the stair extensions 32 by means of a bolt and wing nut, clamps, or other quickly disconnectable fastener.

Although the base plate 34 provides a convenient means for mounting a light fixture, the invention can be practiced without the base plate by mounting the light fixture directly to either the steps 28 or the rails 26. With that arrangement (not shown) the translucent panels 100 would still conceal both the fixture and the stair assembly. In either case, the lighting assembly 24 conceals the ceiling aperture 23 and at the same time provides room lighting.

To provide power to the light fixture 200, a power cord 38 connects the light fixture 200 to a suitable electrical junction box 202 and to a switch 204 that can be conveniently wall mounted at a location suitable for access from the room below. The power cord 38 is preferably of the extendable coil type to facilitate its extension when the stair assembly 22 is pulled into its extended position as shown in FIG. 1 and neatly recoiled when the stair assemble is retracted as shown in FIG. 2. To avoid potential cord damage while it is extended and the steps are in use, it may be desirable to provide the coil with an additional protective conduit 40.

As can now be appreciated, these embodiments shown in the drawings and described above are merely illustrative of the invention, and one skilled in construction could readily adapt the basic concept of the invention to a variety of lighting and step configurations. Thus, the embodiments are not exclusive, and do not serve to limit the claimed invention, the scope of which is defined by the following claims.

What is claimed is:

1. A combination pull-down attic stairs and ceiling light comprising:

a stair assembly with an underside and a topside, one end of said stair assembly including means for pivotally mounting said stair assembly to a side portion of a ceiling aperture such that said stair assembly is pivotally retractable into the aperture;

a light fixture; and means for mounting said light fixture to the underside of said stair assembly such that when said stair assembly is retracted into the aperture, said light fixture is positioned underneath the retracted stair assembly to substantially conceal the aperture and the retracted stair assembly from view from below.

2. The combination of claim 1, wherein said stair assembly is foldable.

3. The combination of claim 1, wherein said light fixture includes a cover for mounting about the fixture to substantially conceal said light fixture from below.

4. The combination of claim 1, further comprising a base member interposed between said stair assembly and said light fixture for mounting said light fixture to said stair assembly.

5. The combination of claim 3, wherein said cover includes a frame and a panel.

6. The combination of claim 5, wherein said panel is translucent.

7. The combination of claim 5, wherein said panel is a grating.

8. A combination pull-down attic stairs and ceiling light comprising:

a stair assembly with an underside and a topside;

a light fixture and means for securing said stair assembly above said light fixture, said light fixture having means for pivotally connecting said light fixture to a side portion of a ceiling aperture such that said stair assembly affixed thereto is pivotally retractable into the aperture such that when said stair assembly is retracted into the aperture, said light fixture is positioned underneath the retracted stair assembly to substantially conceal the aperture and the retracted stair assembly from view from below.

9. The combination of claim 8 further comprising a base member interposed between said stair assembly and said light fixture for mounting said light fixture to said stair assembly.

10. The combination of claim 9 further comprising a cover attached to said base member and surrounding said light fixture.

11. The combination of claim 10, wherein said cover comprises a frame and a panel.

12. The combination of claim 11, herein said panel is translucent.

13. The combination of claim 11, wherein said panel is a grating.

14. A combination pull-down attic stairs and ceiling light comprising:

a stair assembly with an underside and a topside, one end of said stair assembly including means for pivotally mounting said stair assembly to a side portion of a ceiling aperture such that said stair assembly is pivotally retractable into the aperture;

a light fixture and means for securing said stair assembly above said light fixture, said light fixture having means for pivotally connecting said light fixture to a side portion of the ceiling aperture such that when said stair assembly is retracted into the aperture, said light fixture is pivotally positionable underneath the retracted stair assembly to substantially conceal the aperture and the retracted stair assembly from view from below.

15. The combination of claim 14 further comprising a base member interposed between said stair assembly and said light fixture for mounting said light fixture to said stair assembly.

16. The combination of claim 15 further comprising a cover attached to said base member and surrounding said light fixture.

17. The combination of claim 16, wherein said cover comprises a frame and a panel.

18. The combination of claim 17, wherein said panel is translucent.

19. The combination of claim 17, wherein said panel is a grating.

* * * * *